US007578105B2

(12) United States Patent
Eberle, III

(10) Patent No.: US 7,578,105 B2
(45) Date of Patent: Aug. 25, 2009

(54) EXPANSION-COMPENSATING DECK FASTENER

(75) Inventor: Harry W. Eberle, III, Lebanon Township, Hunterdon County, NJ (US)

(73) Assignee: Blue Heron Enterprises, LLC, North Branch, NJ (US)

( * ) Notice: Subject to any disclaimer, the term of this patent is extended or adjusted under 35 U.S.C. 154(b) by 380 days.

(21) Appl. No.: 10/446,514

(22) Filed: May 28, 2003

(65) Prior Publication Data

US 2004/0182034 A1 Sep. 23, 2004

Related U.S. Application Data

(63) Continuation-in-part of application No. 10/393,100, filed on Mar. 20, 2003, now Pat. No. 6,851,884.

(51) Int. Cl.
*E04F 15/22* (2006.01)
*E04B 2/00* (2006.01)
*F16B 9/00* (2006.01)

(52) U.S. Cl. ..... 52/403.1; 52/586.1; 52/586.2; 403/231

(58) Field of Classification Search ..... 52/483.1, 52/480, 650.3, 586.1, 586.2, 403.1; 403/231, 403/232.1, 408.1
See application file for complete search history.

(56) References Cited

U.S. PATENT DOCUMENTS

| | | | | | |
|---|---|---|---|---|---|
| 695,722 | A | * | 3/1902 | Heilmann | 52/509 |
| 1,184,080 | A | | 5/1916 | D'Arcy | |
| 1,723,306 | A | * | 8/1929 | Sipe | 52/396.04 |
| 2,332,081 | A | | 10/1943 | Hunt et al. | |
| 2,362,252 | A | * | 11/1944 | Ellinwood | 52/288.1 |
| 2,398,603 | A | | 4/1946 | Soderberg | |
| 2,406,387 | A | | 8/1946 | Lank | |
| 4,454,699 | A | * | 6/1984 | Strobl | 52/585.1 |
| 4,599,841 | A | * | 7/1986 | Haid | 52/396.04 |
| 4,641,988 | A | | 2/1987 | Ganner | |
| 4,682,458 | A | | 7/1987 | Sparrow | |
| 5,004,027 | A | | 4/1991 | Legler et al. | |
| 5,182,891 | A | | 2/1993 | Slocum | |
| 5,251,996 | A | | 10/1993 | Hiller et al. | |
| 5,359,954 | A | * | 11/1994 | Kordelin | 114/85 |
| 5,377,732 | A | | 1/1995 | Fujii et al. | |
| 5,458,433 | A | | 10/1995 | Stastny | |
| 5,480,117 | A | | 1/1996 | Fleming, III | |
| 5,529,428 | A | | 6/1996 | Bischof | |

(Continued)

*Primary Examiner*—Richard E Chilcot, Jr.
*Assistant Examiner*—Mark R Wendell
(74) *Attorney, Agent, or Firm*—Ernest D. Buff & Associates, LLC; Ernest D. Buff; Gordon E. Fish

(57) ABSTRACT

The present invention is an anchoring biscuit device for joining three boards. It includes, (a) an at least partially flat horizontal top element having an imaginary center line, having opposite side walls, and having a top view footprint adapted to be inserted into grooves of adjacent boards; (b) at least one substantially vertical support member attached to the underside of the top element and extending downwardly therefrom for a predetermined length for joinder of two adjacent boards which contain said grooves for receiving portions of said top into said grooves; and, (c) at least one compressive element located on aid device, with at least a portion of said at least one compressive element, from a top view footprint, being located away from said imaginary center line and way from said vertical support member, wherein said compressive element is adapted to at least partially collapse under predetermined compressive force.

18 Claims, 6 Drawing Sheets

U.S. PATENT DOCUMENTS 5,660,016 A * 8/1997 Erwin et al. ..... 52/483.1
6,032,431 A * 3/2000 Sugiyama ..... 52/656.9
6,363,677 B1 * 4/2002 Chen et al. ..... 52/586.1
6,402,415 B1 * 6/2002 Eberle, III ..... 403/231
6,470,641 B1 * 10/2002 Faure ..... 52/480
D470,039 S * 2/2003 Pelc ..... D8/382
6,651,400 B1 * 11/2003 Murphy ..... 52/586.2
6,711,864 B2 * 3/2004 Erwin ..... 52/582.1
6,871,467 B2 * 3/2005 Hafner ..... 52/586.1
2002/0059766 A1 * 5/2002 Gregori ..... 52/489.1

* cited by examiner

EXPANSION-COMPENSATING DECK FASTENER

REFERENCE TO RELATED APPLICATION

This application is a continuation-in-part of U.S. patent application Ser. No. 10/393,100 filed on Mar. 20, 2003, now U.S. Pat. No 6,851,884 entitled "Decking Anchor Device", by the same inventor herein.

BACKGROUND OF THE INVENTION

1. Field of the Invention

The present invention is directed to an improved biscuit for joining adjacent boards. More specifically, the invention is an anchoring biscuit device that has the ability for pre-setting distances between adjacent boards and attaching to at least one board by means in addition to the biscuit itself. The anchoring biscuit device physically joins two adjacent boards in the same plane to a third, supporting board. The anchoring half-biscuit device joins two adjacent boards at right angles to one another. Further, the present invention anchoring biscuit includes compressive elements to accommodate swelling and expansion of boards after installation.

U.S. Pat. No. 6,402,415, issued to the present inventor herein covers such biscuit devices having opposite side walls in the shape of arcs. These would include side walls with arcs and flat ends, side walls with arcs and arc ends, e.g. circles, ellipses, etc. The present invention covers biscuit-shaped devices with side walls that may have the same top view footprint as the Eberle U.S. Pat. No. 6,402,415 devices, and covers anchoring devices that may not have opposite arcs, and may or may not have biscuit shapes. However, all of the present invention devices do include at least one compressive element, namely, a portion of the device that will collapse or move under compression (from opposing expansion or swelling of wood).

2. Information Disclosure Statement

The following patents are representative of the state of the art for wood joining devices, equipment and methods:

U.S. Pat. No. 1,184,080 to D'Arcy describes a structure of the class described, the combination of frame pieces disposed at an angle to each other and plate-like corner irons having angularly disposed flanges, said corner irons being arranged in opposed pairs on the sides of and secured to the ends of meeting frame pieces with their flanges engaging the inner edges thereof in overlapping telescoping relation to each other, the inner flanges having vertical nail slots therein and brads on their edges driven into the frame pieces, the outer flanges having nail perforations opposite the nail slots, there being nails disposed through the said perforations and slots and driven into the frame.

U.S. Pat. No. 2,332,081 to G. M. Hunt et al is directed to a wooden panel. It is described as a panel comprising wooden strips joined along their edges with glue, each strip having at least one groove in its edge matching groove in the edge of the adjoining strip, an asbestos millboard spline fitted in the matching grooves and bridging the joint between the strips, crossbands covering the strips on both sides of the panel, and veneers covering the crossbands. U.S. Pat. No. 2,362,252 to Ellinwood describes a wall structure of the character described comprising a pair of adjacent wallboard panels having meeting edges, each of said panels being formed with a groove opening into its meeting edge, the groove in each panel providing an outer lip and an inner lip, said outer lips being in abutting relation, a joining strip permanently secured to the under surface of said outer lips, said inner lips being spaced, a T-shaped connecting member movably positioned in said groove and having a base in spaced relation to said inner lips, and means for anchoring said connecting member to a structural element.

U.S. Pat. No. 2,398,603 to Soderberg describes a joining staple, comprising a metal body having at least two portions extending at right angles to each other and at least two teeth carried upon each of said portions, each of said teeth consisting of a flat substantially rectangular body having a cutting edge extending substantially parallel to its body portion, the cutting edges of all of said teeth being located in one plane, each of said portions having another cutting edge extending between the teeth of that portion, the second mentioned cutting edges being also located in one plane.

U.S. Pat. No. 2,406,387 to Lank describes the method of constructing a plurality of wooden posts each of which has a connector element incorporated therein adjacent each end thereof which method comprises forming a plurality of longitudinally extending grooves in one side of each of a pair of wooden blanks from which the posts are to be formed, forming a transverse groove adjacent each end of said side of each of said blanks with the transverse grooves intersecting the longitudinal grooves, providing a pair of connector retaining members with a plurality of seats for receiving connector elements, the number and spacing of said seats in each of said connector retaining members conforming to the number and spacing of the longitudinal grooves in each of said blanks, placing connector elements in each of said seats, positioning said blanks with their grooved sides together and with said connector retaining members in said transverse grooves, bonding said blanks together, and severing the thus bonded assembly along longitudinal lines intermediate said longitudinal grooves.

U.S. Pat. No. 4,641,988 to Ganner is directed to a fitting for releasably joining two structural components. It is illustrated for releasably joining two structural components particularly plate-shaped structural components which extend at a right angle relative to one another, a fitting has a preferably cylindrical locking element which can be inserted either directly in a bore in the first structural component or it can be inserted indirectly in a housing, and a holding piece with a holding projection anchored in the second structural component. In the assembled position, the holding projection & abuts against one or two gripping surfaces of the locking element which gripping surfaces are of, for example, eccentric shape, and the holding projection is pulled toward the locking element when the locking element is turned. The holding piece is constructed plate-shaped and is insertable in a slot in the second structural component.

U.S. Pat. No. 4,682,458 to Sparrow describes a floor composed of parallel spaced beams having flanges and blocks of polystyrene foam which are laid on the flanges to bridge the gaps between the beams. Boards are laid on the polystyrene blocks, and are supported by the blocks, which form load-bearing members of the floor. The blocks may have flanged portions extending over the beams, so as to provide heat insulation.

U.S. Pat. No. 5,004,027 to Legler et al illustrates a biscuit joiner. It is described as a biscuit joiner for cutting semi-elliptical slots in opposing edges of workpieces which are to be joined along those edges includes a housing adapted to be mounted upon the quill of a multipurpose woodworking tool, which housing encloses a rotary saw blade adapted to be attached to a spindle projecting from the quill on which the housing is mounted. A spring loaded guide projects from the front face of the housing and has a slot therethrough, so that when the front face of the guide is engaged by an edge of a workpiece to be slotted the guide can be pushed inwardly against spring pressure, allowing the rotary saw blade to be exposed and form a slot in the edge of the workpiece. Adjustable stops are provided on the guide so that a desired depth of cut will automatically be made after adjustment. An alternative construction of this biscuit joiner is especially adapted for use in conjunction with a conventional drill press, with the arbor which carries the saw blade being clamped in the chuck on the drive spindle of the drill motor.

U.S. Pat. No. 5,182,891 to Slocum describes a flooring construction which is provided having a unitary construction with a top layer providing a finished flooring surface and an insulation layer adjacent the top layer. The flooring panel includes an upper portion and a lower portion. The upper portion has a larger dimension than the lower portion and extends outwardly beyond the lower portion. A recessed portion between the upper portion and the lower portion defines a channel. A plurality of interlock support elements having a vertical web and an upper horizontal flange are arranged so that the horizontal flange extends into the channel. The vertical web extends below the lower portion to raise the flooring.

U.S. Pat. No. 5,251,996 to Hiller et al describes a connecting element for connecting two parts generally in a connection plane has a first portion for connecting the element relative to a first of the parts and second portion for connecting the element relative to the second part. The second portion includes actuation members which on relative movement of the parts substantially along the connection plane urge the parts forcefully towards each other.

U.S. Pat. No. 5,377,732 to Fujii et al illustrates a wood joining structure and method thereof. It is described as a technique is provided for joining wood members. A plurality of slits are formed on the end portions of wood pieces desired to be joined, and the end portions are abutted with corresponding slits in alignment to form a common surface. Each of the abutted wood end portions is fixed by temporary fixing means to a desired joining state. Thereafter, an adhesive agent is applied into the interior surfaces of the slits. Connecting plates, e.g., made of a reinforced plastic material coated with the adhesive agent, are inserted into the aligned slits. The adhesive agent is then hardened.

U.S. Pat. No. 5,458,433 to Stastny explicates a biscuit and joint made using same. It is described as a biscuit having octagonal outer periphery is used to form a joint between first and second workpieces. The biscuit fits within arcuate slots formed in the workpieces, with glue placed in the slots and/or on the biscuit before the joint is put together. The biscuit is made of an anhydrous compressed wood.

U.S. Pat. No. 5,480,117 to Fleming, III describes a bracket for mounting a rotary lock member in the frame of a panel which is provided. The bracket is a preferably U-shaped body having a base and two legs extending therefrom. The inner dimension of the bracket is chosen to allow insertion of a rotary lock member therein. Panel engaging steps and protrusions are located on the outside surface of each leg for engaging the frame material. The legs of the bracket are biased inwardly towards one another, such that when a locking member is inserted therein, the legs are pressed outwardly, driving the protrusions into the frame material. A number of bores are located in the bracket to allow supplemental locking members to lock the bracket to the frame.

U.S. Pat. No. 5,529,428 to Bischof is directed to a metallic structural element for connecting workpieces consisting of wood, woodworking material or plastic. It is described as a metallic structural element for connecting workpieces consisting of wood, woodworking material or plastic, consisting of a lamellar part, which provides the non-positive connection with the first workpiece provided with a groove and a transverse hole, and a bolt-like part which, through screwing or pinning, realizes the non-positive connection with the second workpiece provided with a longitudinal hole. The lamellar part has, in the center, a hole which is at right angles to the plane of the lamella and is intended for fixing in the groove of the workpiece. Variants having a wing-like long or rectangular short lamellar part and a bolt-like part in the form of a conical wood screw, cylindrical screw, screw having a metal thread, threaded sleeve or pin. Accessories: screwing tool and drilling template.

U.S. Pat. No. 5,660,016 to Erwin et al describes an extruded plastic decking plank for mounting to an underlying support structure, the plank having a rigid foam core, a resilient outer plastic shell, and a clamping portion for securing the plank to the support structure. The top surface of the plank can be provided with a non-slip surface. The invention also includes an attachment system for securing such decking planks to a support structure by engaging the clamping portions of the decking planks onto clamps or hold down blocks which are secured onto the support structure, and which permit relative motion between the planks and the structure in the planks' lengthwise direction to prevent stress and buckling caused by uneven expansion.

U.S. Pat. No. 6,402,415, to Eberle, the same inventor herein, describes an anchoring biscuit device for joining three boards. It includes, (a) a first substantially flat horizontal top element having a generally biscuit-shaped configuration, (b) at least one substantially vertical support member attached to the underside of the top element and extending downwardly therefrom for a predetermined length for joinder of two adjacent boards which have been pre-cut with biscuit receiving slots, and (c) an attachment orifice located at least on the top element for attachment of the anchoring biscuit device to a support board for anchoring and support of the two adjacent boards. In one preferred embodiment, a top bevel is included at the orifice to permit angled screwing at positions other than vertical positions. In other embodiments, the screw orifice will have an oval or elongated shape to likewise enable screwing at angles other than vertical. In yet another preferred embodiment, the orifice will both be beveled and elongated.

U.S. Design Pat. No. 470,039 to Robert Pelc shows two anchoring biscuit devices of the U.S. Pat. No. 6,402,415 Eberle type, one having a circular footprint and the other having an elliptical footprint.

Notwithstanding the prior art, the present invention is neither taught nor rendered obvious thereby.

SUMMARY OF THE INVENTION

The present invention is an anchoring biscuit device for joining three boards. It includes, (a) an at least partially flat horizontal top element having opposite side walls, and, from a top view, having a footprint adapted to be inserted into grooves, (b) at least one substantially vertical support member attached to the underside of the top element and extending downwardly therefrom for a predetermined length for joinder of two adjacent boards which contain grooves for receiving portions of said top into said grooves, and, (c) at least one compressive element located on said device with at least a portion located away from said imaginary centerline, said compressive element being adapted to at least partially collapse upon compressive force. In some embodiments, there is also an attachment orifice located at least on the top element for attachment of the anchoring biscuit-device to a support board for anchoring and support of the two adjacent boards.

In one preferred embodiment, a top bevel is included at the orifice to permit angled screwing at positions other than vertical positions. In other embodiments, the screw orifice will have an oval or elongated shape to likewise enable screwing at angles other than vertical. In yet another preferred embodiment, the orifice will both be beveled and elongated. In other embodiments, there is no preformed orifice, and the device may be attached by a screw or other fastener being driven through the device, or attached by adhesive or other means, or combinations thereof.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
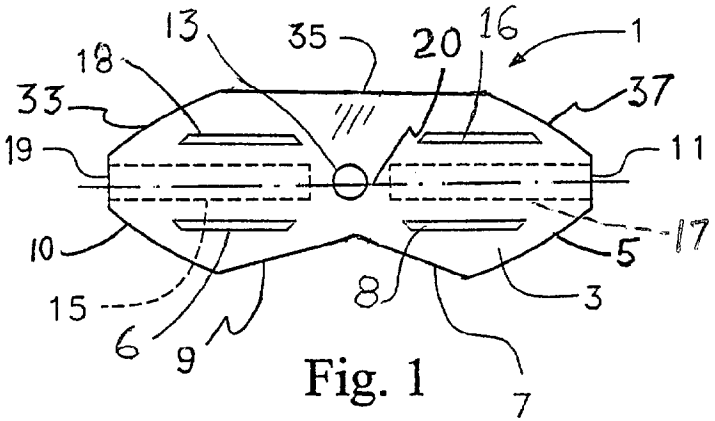
FIG. 1 illustrates a top view of one preferred embodiment of the present invention anchoring device.

In FIG. 1, there is shown a top view of present invention anchor biscuit device 1. Device 1 includes a top element 3 having a flat top surface as shown, and a top view shape of a biscuit. It also includes a first wall with segments 5, 7, 9 and 10, with wall segments 5 and 7 in the shape of arcs having predetermined radii and predetermined arc lengths, and wall segments 7 and 9 having flat edges (straight surfaces). There is a second, opposite wall having segments 33, 35 and 37, with 33 and 37 being arcs, and 35 being a straight flat surface. They are not parallel to their segments directly opposite, i.e., opposite as determined at a 90° angle to imaginary center line 20.

Top element 3 also includes an attachment means, in this case, screw hole 13 located on center. This enables the user to nail or screw device 1 into a joist, as more fully described in conjunction with FIG. 4 below. Alternatively, device 1 could simply have an area where a screw could be forced through, without a pre-formed orifice.

Top element 3 includes four upwardly projecting compressive elements 6, 8, 16 and 18. These are located opposite one another, as shown, are located away from imaginary center line 20. Also, they are located away from the vertical support members 15 and 17 (from top view) and are further away from the vertical support members at their outermost portions, from the centerline, than the outermost portions of the vertical support elements. This concept applies to the other present invention devices described below, as well.

Figure 3:
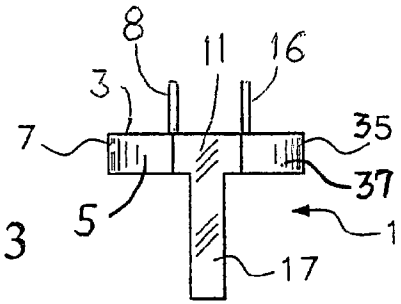
FIG. 3 illustrates an end view thereof.
Figure 2:
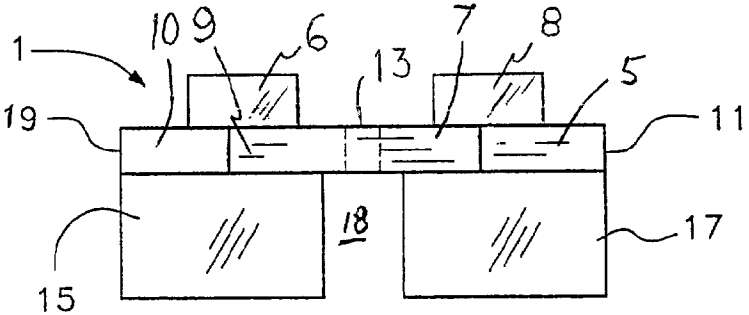
FIG. 2 illustrates a side view.

FIGS. 2 and 3 show side and end views, respectively of device 1 shown in FIG. 1. Thus, device 1 includes vertical support members 15 and 17 with a space 18 there between to permit a screw or nail to pass through screw hole 13 into a joist or support board. Vertical support members 15 and 17 have a predetermined height so as to rest on a joist in such a way as to establish biscuit top element 3 at a predetermined height from the joist for attachment of two adjacent boards thereto which have pre-cut biscuit slots. The device such as device 1 are not set for full nesting (i.e., do not have total footprint identity) with the biscuit cut, and need only have sufficient overhang on each side of the centerline 20 to catch and anchor a board by at least partially fitting into a cut out of a deck or other board. The compressive elements 6, 8, 16 and 18 act as initial spacers for the two adjacent boards.

Figure 4A:
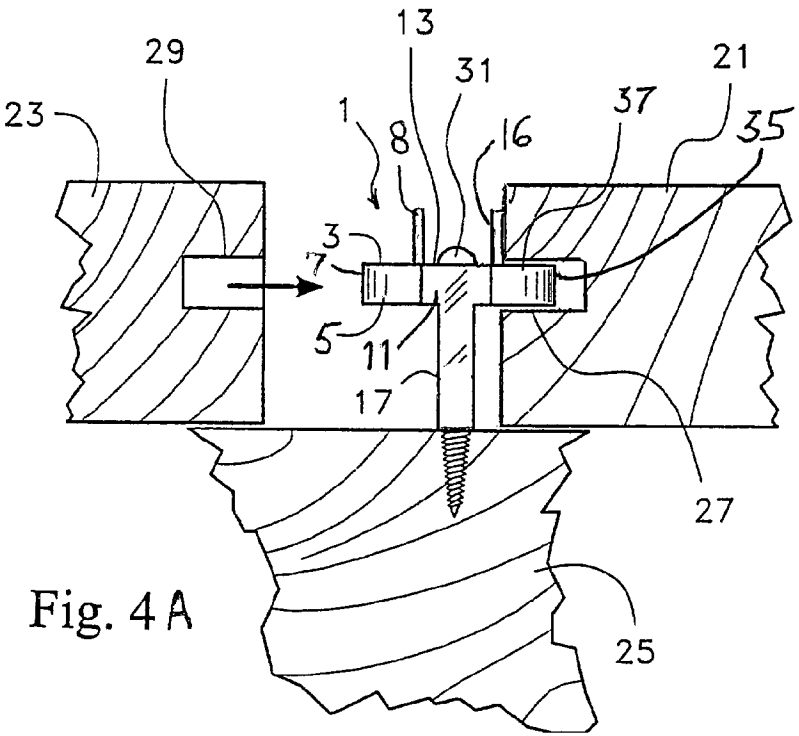
FIG. 4A shows an end view of the present invention device shown in FIGS. 1 through 3 but being attached to a joist and a first deck board and about to be attached to a second deck board where both deck boards are supported by that joist.
Figure 4B:
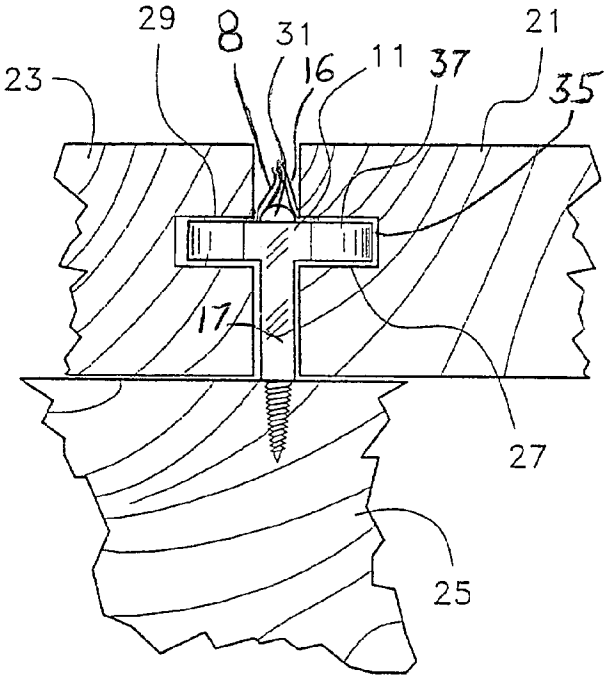
FIG. 4B shows an end view of the same present invention device as above, but fully installed and after the adjacent beams have swollen and collapsed the compressive elements.

FIG. 4A shows present invention device 1 from the prior Figures, with identical parts identically numbered. Top element rear biscuit wall 35 is partially inserted into pre-cut biscuit slot 27 of horizontal beam 21, as shown. Compressive elements 16 (and 18, not shown) place beam 21. Screw 31 is inserted into screw hole 13 and into joist beam 25. This anchors device 1 to joist beam 25 and establishes the elevation of top element 3 so as to match with biscuit slot 27. Beam 23 will be placed atop joist beam 25 and adjacent to beam 21 by being slid into position with wall segments 5, 7, 9 and 10 at least partially fitting into slot 29, and the bottom of beam 23 resting on joist 25. By this method, device 1 attaches all three boards to one another as the side wall aspects are sufficiently tight-fitting to anchor the boards. Thus, for example, decking boards may be attached without the need for nails or screws entering the beams from the top, creating a hidden fastening system.

Compressive elements 8 (and 6, not shown in FIG. 4) place beam 23. In other words, the compressive elements 6, 8, 16, 18 space the beams 21 and 23 further apart than the vertical support members 15 and 17 would in their absence. These beams 21 and 23 might expand due to damp weather, rain, capture of moisture, high humidity, seasonal changes, shifts, etc. When this occurs, compressive elements will be pushed toward one another and collapse, e.g. in excess of 10 foot pounds psi, or some other preset parameter. The collapse of compressive elements permits the beams to close in on one another to the sides of the vertical support members. This is clearly illustrated for the FIG. 4A embodiment, in FIG. 4B. Here, compressive elements have been forced to collapse inwardly by expanding beams 21 and 23, as exemplified by collapsed compressive elements 8 and 16. All parts are identically numbered as shown in the foregoing Figures.

Figure 5:
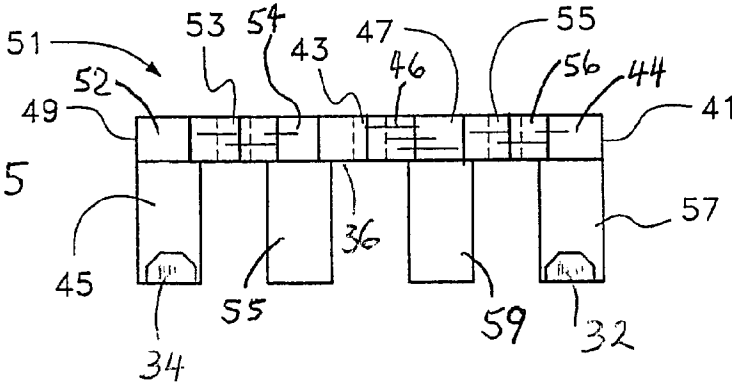
FIGS. 5 and 6 show a side view and a bottom view, respectively, of an alternative embodiment present invention anchoring biscuit device.
Figure 6:
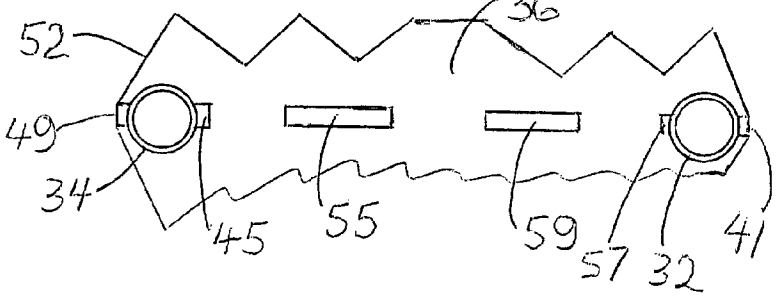

FIG. 5 shows an alternative embodiment present invention device 51 which has multiple screw holes 43, 53 and 55 located in a straight line on center of top element 47. It includes front and back ends 41 and 49, and it has a plurality of vertical support members 45, 47, 57 and 59, on top underside 36 with spaces therebetween for screw or nail insertions. Vertical support members 45 and 57 include compressive elements 34 and 32, as shown. FIG. 6 shows a bottom view with identical numbering. Note that compressive elements 32 and 34 are essentially hollow cylinders in this embodiment. The side walls have a footprint of sawteeth on both sides. On the side out of the drawing, segments 52, 53, 54, 43, 46, 47, 55, 56 and 44 form the sawteeth. Segments directly opposite one another are mostly non-parallel. Device 51 is used in the same manner as device 1 described above with respect to FIGS. 4A and B, except that the compressive elements 32 and 34 collapse on the underside of the device, inwardly between portions of a single vertical support member.

Figure 7:
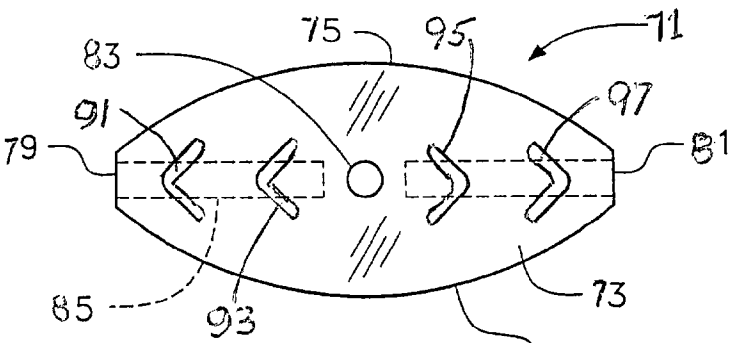
FIGS. 7 and 8 show top and side views of another alternative present invention anchoring biscuit device.
Figure 8:
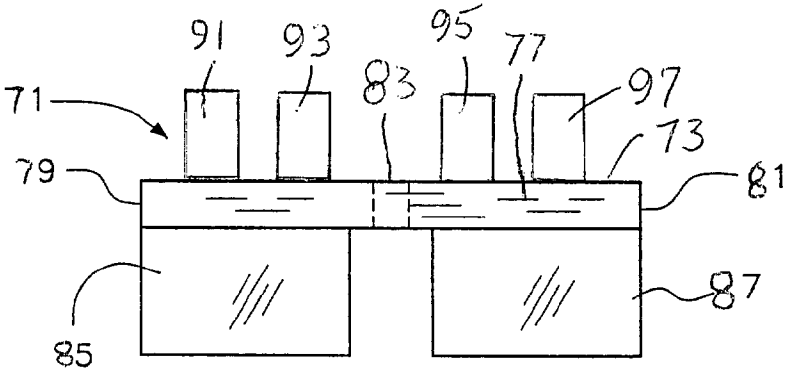

FIGS. 7 and 8 show top and side views of an alternative embodiment present invention anchoring device 71. In FIG. 7, there is shown a top view of present invention anchor biscuit device 71. Device 71 includes a top element 73 having a substantially flat top surface as shown, and a top view shape of a biscuit. Thus, it includes wall segment (an arc), on one side and wall segments 77 (an opposing arc), and on the opposite side. Segment 62, for example, is non-parallel to segment 66. There are flat ends 79 and 81, as shown.

Top element 71 of device 71 in FIG. 7 also includes an attachment means, in this case, screw hole 83 located on center. It also includes fount chevron-shaped compressive elements 91, 93, 95, and 97. These compress if adjacent boards expand and enable extra spacing to be achieved during installation to accommodate any future wood expansion that may occur.

In FIG. 8, there is shown a side view of the present invention anchor biscuit device 71. Device 71 includes a top element 73, showing the height and depth of compressive elements 91, 93, 95, and 97.

Figure 9A:
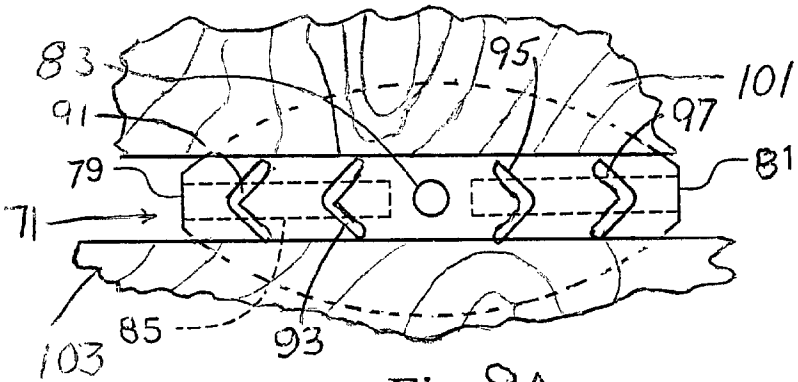
FIGS. 9A and 9B show top views of the FIG. 7 and FIG. 8 present invention device, installed with beams, before and after beam expansion.
Figure 9B:
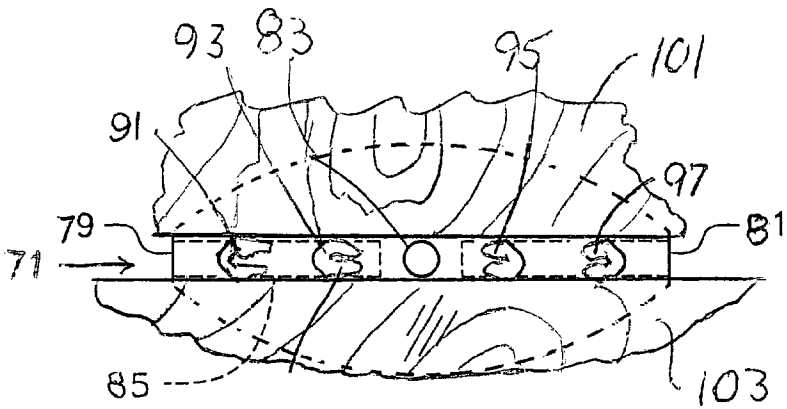

FIG. 9A shows a top view of device 71 with installed beams 101 and 103, and these are not swollen. In FIG. 9B, the same beam 101 and 103 have swollen, and the compressive elements 91, 93, 95, and 97 have collapsed, as shown.

Figure 10:
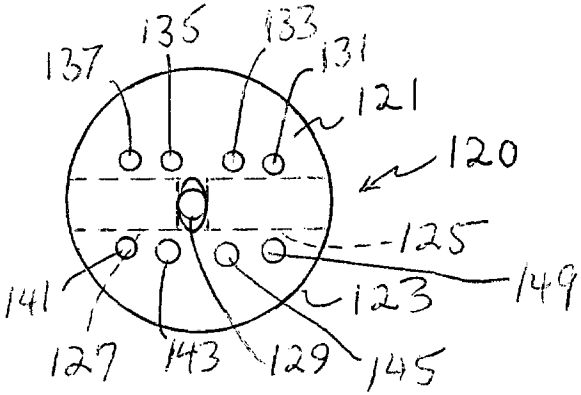
FIGS. 10 and 11 illustrate top and side views of another present invention device.
Figure 11:
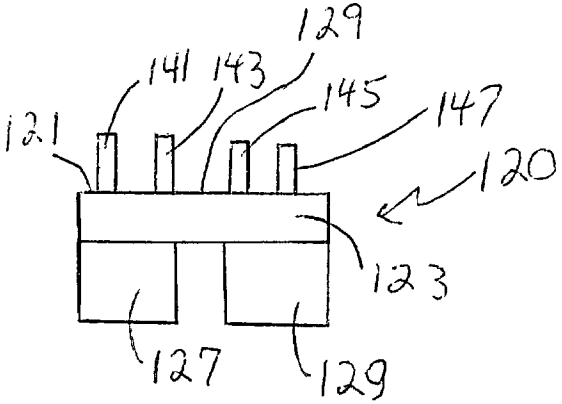

FIG. 10 shows a top view and FIG. 11 shows a side view of present invention device 120. It includes a substantially flat top element 121, that has a top view footprint of a circle, and two vertical support members 125 and 127, that project downwardly on each side of beveled attachment orifice 129. The sides of device 20's top 121 are vertical and basically are made up of a plurality of connected (continuous) arcs to form a circle. On the top side of device 120 are eight compressive elements 131, 133, 135, 137, 139, 141, 143, 145, and 147. These are thin cylindrical protrusions that will collapse under compression, e.g. from expanding boards. As shown in FIG. 10, they are further apart than the thickness of the vertical support members to create space between beams for expansion.

Figure 12:
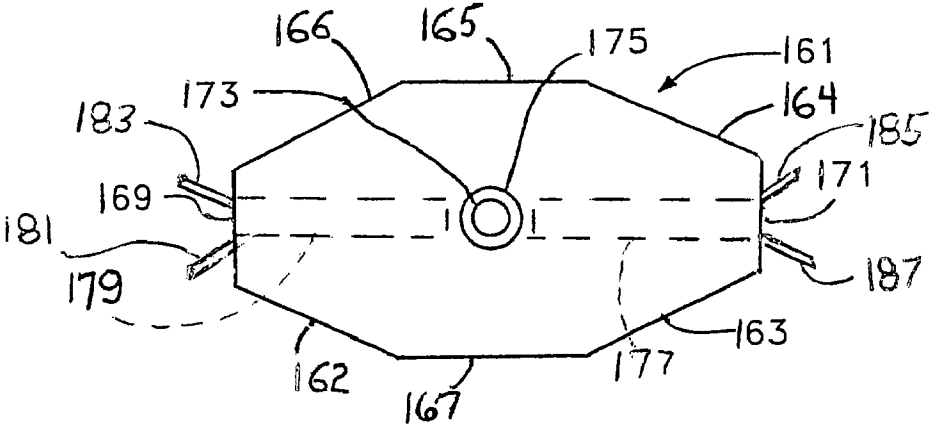
FIG. 12 and FIG. 13 show top views of two different embodiment present invention anchoring biscuit devices having compressive elements located below the substantially flat top element.
Figure 13:
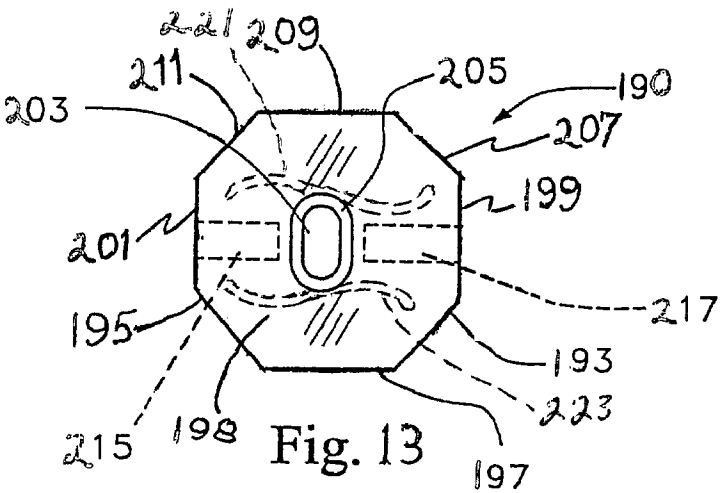

FIGS. 12 and 13 show top views of alternative embodiment present invention anchoring devices 161 and 190 respectively. In FIG. 12, there is shown a top view of present invention anchor biscuit device 163 having a flat top surface as shown, and a top view shape of an elongated octagon biscuit. Thus, it includes wall segments 164, 165, and 166 on one side wall and wall segments 162, 167, and 163 on the opposite side. Segments 162, for example, is non-parallel to segment 166. There are flat ends 169 and 177, as shown.

Top element 163 of device 161 in FIG. 12 also includes an attachment means, in this case, screw hole 173 located on center. Screw hole 173 has a bevel cut 175 at its top. This enables the user to nail or screw device 161 into a joist with the screw or nail being installed vertically, or, more preferably, at an angle.

Vertical support members 177 and 179 also include outwardly extending, angled tails 181, 183, 185, and 187 and these are the collapsible compressive elements.

In FIG. 13, there is shown a top view of present invention anchor biscuit device 190, in the shape of an octagon biscuit. Device 190 includes a top element 198 having a flat top surface as shown, and a top view shape with eight equal segments; a first side with wall segments 193, 197, and 195, and an opposite side with wall segments 207, 209, and 211. In this case, they are perfectly symmetrical and have flat endwalls 199 and 201. Top element 198 also includes an attachment means, screw hole 203 located on center. Note that screw hole 203 is elongated and has a beveled top 205. Underside of top element 198 are two curved collapsible compressive elements 221 and 223. These function similarly to those described above.

Figure 14:
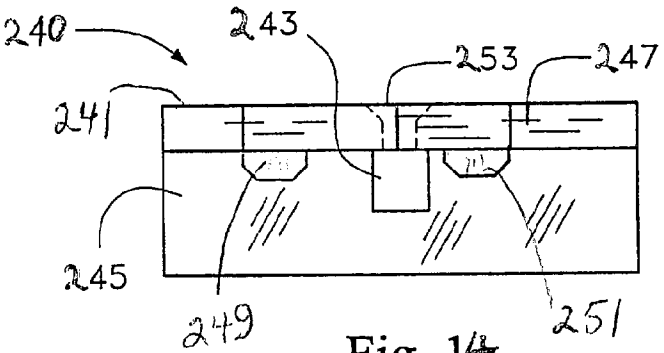
FIGS. 14 and 15 show additional alternative embodiment present invention anchoring devices, in their side views; and, FIGS. 16 and 17 show more present invention alternatives in their side views; and, FIGS. 18, 19, 20, and 21 show top, side, end and embossed top views of another preferred embodiment present invention anchoring device.

FIG. 14 shows a front view of present invention device 240. Thus, device 240 includes a single vertical support member 245 with a space cut out 243 to permit a screw or nail to pass through beveled screw hole 253 and through vertical support member 245 into a joist or support board. There are two collapsible fins on each side of the vertical support member 245, two shown as fins 249 and 251. These are about 3/64 inch away from member 245 and act as collapsible compressive elements in a manner similar to those shown above. Vertical support member 245 has a predetermined height so as to rest on the side of a beam into which device 240 may be inserted and, optionally, so as to rest on a joist in such a way as to establish biscuit top element 247 at a predetermined height from the joist for attachment of two adjacent boards thereto which have pre-cut biscuit slots corresponding thereto. Side walls may be irregular or regular, and may have any top view, workable footprint similar to that shown in the segments that will fit into beam grooves or continuous straight grooves, e.g. biscuit cuts, half circle or arc cuts, square or rectangular cuts.

Figure 15:
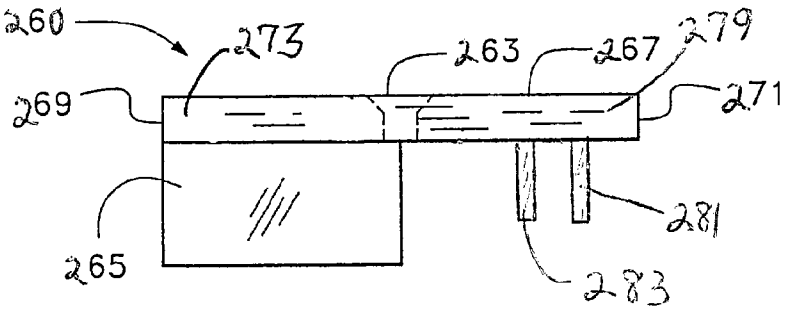

FIG. 15 shows a front view present invention of device 261, which includes a single off-center vertical support member 265 with a space underneath beveled screw hole 263 to permit a screw or nail to pass through screw hole 263 into a beam and/or joist or support board. Top 267 has opposite ends 269 and 271 as shown, with support member 265 biased to the left toward end 269, as shown. On the right underside of top 267 are two fins 281 and 283, that have lengths (into the page, at right angle to vertical support member 265), that is greater than the thickness of member 265. They are collapsible and act as compressive elements with respect to adjourning boards. Top 263 has a topography with flat sides, such as side 273, and is in the shape of a rectangle, e.g. a square.

Figure 16:
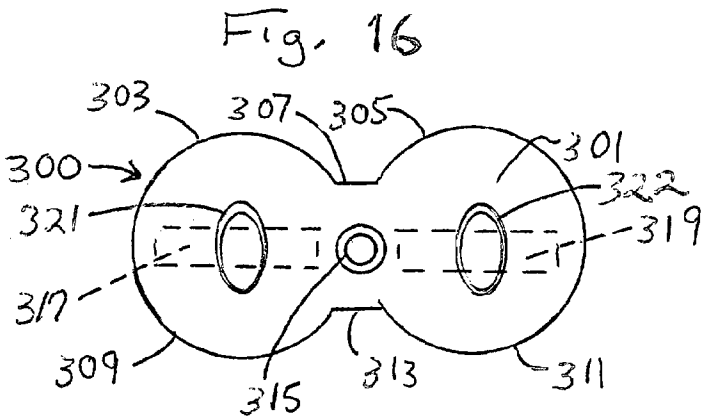

FIG. 16 shows device 300 with top 301 having a generally barbell-shaped footprint. There is a first side having wall segments 303 and 305 that are arcs and are connected by flat segment 307. The opposite wall includes arcs 309 and 311 and are separated by flat segment 313. Wall segments 303 and 309 are opposite one another and are non-parallel. There is a beveled orifice 315 which is attaching device 300 in a manner described above as well as vertical segments 317 and 319 extending downwardly from top 301 on opposite sides of orifice 315. There are two collapsible compressive element ovals 321 and 322 extending upwardly. These space beams further apart than would members 317 and 319, in their absence, and thus accommodate wood expansion.

Figure 17:
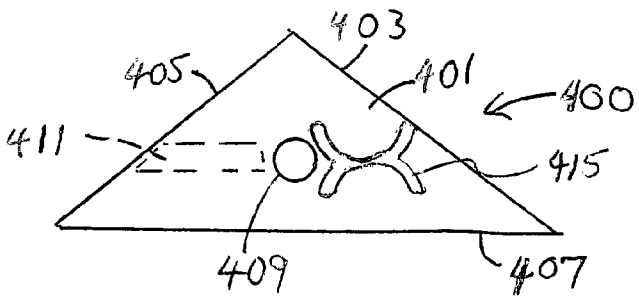

FIG. 17 shows a triangular shaped present invention anchoring device 400. It has a top 401, an orifice 409 for attachment and a vertical support 411. One wall has flat segments 403 and 405 and the opposite wall has a single flat segment 407. There is a collapsible compressive element 415 on top to function in a manner similar to those previously described.

Figure 21:
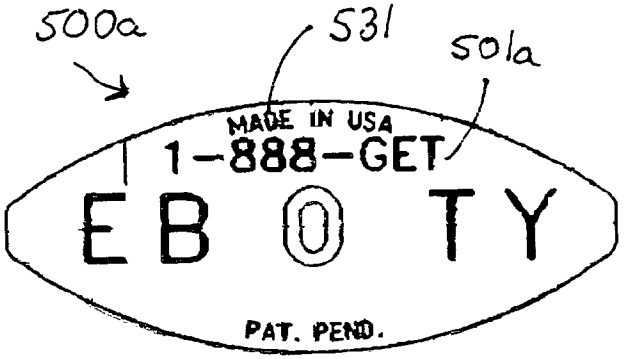
Figure 20:
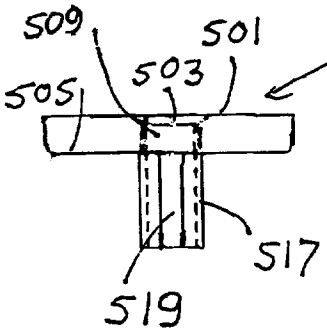
Figure 18:
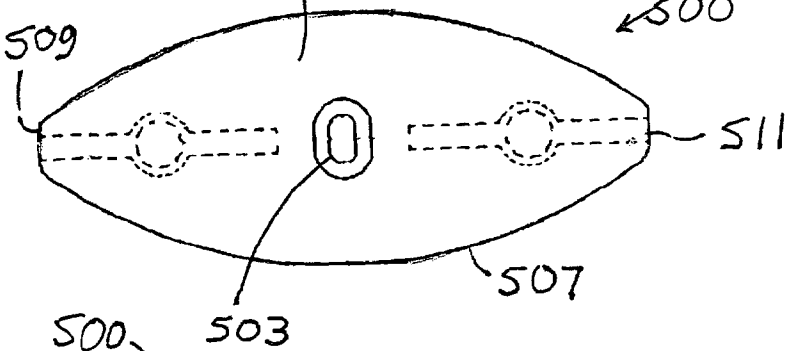
Figure 19:
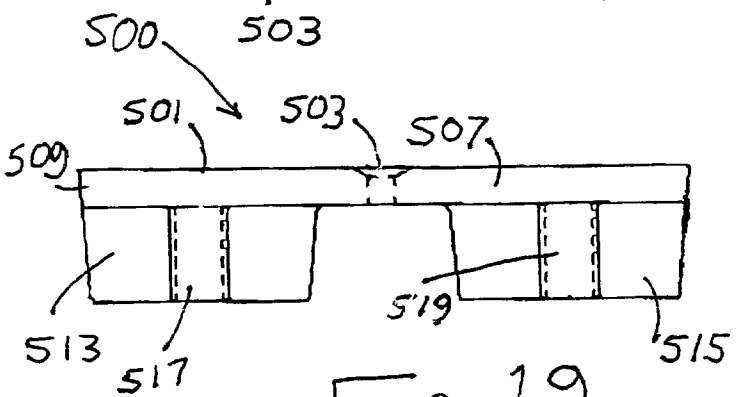

FIGS. 18, 19 and 20 illustrate preferred embodiment present invention anchoring device 500, in its top, side and end views respectively. Device 500 includes top 501 with beveled screw orifice 503 on center. Opposing sides 505 and 507 are arcuate and ends 509 and 511 are flat. Extending downwardly are vertical support members 513 and 515, located on-center and on opposite sides of orifice 503. The vertical support member 513 and 515 each have one thin walled tubular compressive element, shown as compressive elements 517 and 519, respectively. Further, FIG. 21 shows top view of the same device as in FIGS. 18, 19, and 20, except that the top is embossed or stamped. Here, device 500*a* includes top 501*a* with embossments such as word 531, that can be production information, size, model number, installation instructions or other useful information. These are preferably indented and may be established in a forming mold for the device.

All of these devices may be installed in accordance with the descriptions for previous present invention devices described above. However, device 260 shown in FIG. 14 should have the arrowed wall inserted first so that the biased beveled orifice 296 is utilized maximally and receiving an attachment screw.

Obviously, numerous modifications and variations of the present invention are possible in light of the above teachings. It is therefore understood that within the scope of the appended claims, the invention may be practiced otherwise than as specifically described herein.

What is claimed is:

1. An anchoring biscuit device for joining three boards, which comprises:

(a) an at least partially flat horizontal top element having a center line, having opposite side walls, and having a top view footprint adapted to be inserted into grooves of adjacent boards;

(b) at least one substantially vertical support member attached to the underside of said top element along said center line of said top element and extending downwardly therefrom for a predetermined length to maintain said top element in a predetermined position during use for joinder of two adjacent boards which contain said grooves for receiving portions of said top into said grooves; and, (c) a plurality of hollow cylindrical compressive elements located on said device, with at least a portion of each of said compressive elements, from a top view footprint, being located away from said center line and away from said vertical support member, wherein said compressive elements are adapted to at least partially collapse under predetermined compressive force, and wherein said compressive elements are located on top of said top element.

2. The anchoring biscuit device of claim 1 which further includes (d) an attachment orifice, said attachment orifice being at least one screwhole located on said top element for screwing of said anchoring biscuit device to a support board.

3. The anchoring biscuit device of claim 1 wherein there is one vertical extended member extending downwardly from said vertical support member, said vertical extended member containing at least one cut out for securing said device to a support board.

4. The anchoring biscuit device of claim 2 wherein said attachment orifice has a beveled top.

5. The anchoring biscuit device of claim 1, further comprising at least one other compressive element located under said top element.

6. The anchoring biscuit device of claim 5 wherein said at least one other compressive element is located on said at least one substantially vertical support.

7. The anchoring biscuit device of claim 1 wherein said top element has a top view footprint shape selected from the group consisting of square, rectangular, circular, and oval.

8. The anchoring biscuit device of claim 1 wherein there is a single vertical support member and it is located offcenter and to one side of said attachment orifice.

9. The anchoring biscuit device of claim 8 wherein said at least one compressive element is located under said top element offcenter and opposite said single vertical support member relative to said attachment orifice.

10. The anchoring biscuit device of claim 9 wherein said at least one compressive element is elongated non-parallel to said single vertical support member.

11. An anchoring biscuit device for joining three boards, which comprises:

(a) an at least partially flat horizontal top element having a center line, having opposite side walls, and having a top view footprint adapted to be inserted into grooves of adjacent boards;

(b) two substantially vertical support members attached to the underside of said top element along said center line of said top element and extending downwardly therefrom for a predetermined length to maintain said top element in a predetermined position during use for joinder of two adjacent boards which contain said grooves for receiving portions of said top into said grooves; and wherein there is at least one screwhole located substantially in the center of said top element and said two substantially vertical support members are attached to said top element, said two vertical support members being substantially flat, being in the same plane and one of each being located on opposite sides of said at least one screwhole;

(c) a plurality of hollow cylindrical compressive elements located on said device, with at least a portion of each of said compressive elements, from a top view footprint, being located away from said center line and away from said vertical support members, wherein said compressive elements are adapted to at least partially collapse under predetermined compressive force.

12. The anchoring biscuit device of claim 11 wherein said hollow cylindrical compressive elements are located on top of said top element.

13. The anchoring biscuit device of claim 11 wherein said hollow cylindrical compressive elements are located under said top element.

14. The anchoring biscuit device of claim 13 wherein at least one of said compressive elements is located on each of said substantially vertical support members.

15. The anchoring biscuit device of claim 13, having exactly two of said hollow cylindrical compressive elements, and one of said compressive elements is located on each of said substantially vertical support members.

16. The anchoring biscuit device of claim 11 wherein said top element has a top view footprint shape selected from the group consisting of square, rectangular, circular, and oval.

17. The anchoring biscuit device of claim 11 which further includes (d) an attachment orifice, said attachment orifice being at least one screwhole located on said top element for screwing of said anchoring biscuit device to a support board.

18. The anchoring biscuit device of claim 17 wherein said attachment orifice has a beveled top.

* * * * *